US009616475B2

(12) United States Patent
Pehle

(10) Patent No.: US 9,616,475 B2
(45) Date of Patent: Apr. 11, 2017

(54) METHOD AND DEVICE FOR PRODUCING SEAMLESS STEEL PIPES HAVING LOW ECCENTRICITY

(71) Applicant: Hans Joachim Pehle, Mönchengladbach (DE)

(72) Inventor: Hans Joachim Pehle, Mönchengladbach (DE)

( * ) Notice: Subject to any disclaimer, the term of this patent is extended or adjusted under 35 U.S.C. 154(b) by 0 days.

(21) Appl. No.: 14/439,816

(22) PCT Filed: Oct. 26, 2013

(86) PCT No.: PCT/DE2013/100371
§ 371 (c)(1),
(2) Date: Apr. 30, 2015

(87) PCT Pub. No.: WO2014/067514
PCT Pub. Date: May 8, 2014

(65) Prior Publication Data

US 2015/0298185 A1 Oct. 22, 2015

(30) Foreign Application Priority Data

Nov. 3, 2012 (DE) ..... 10 2012 022 014

(51) Int. Cl.

| | |
|---|---|
| ***B21B 17/02*** | (2006.01) |
| ***B21B 19/04*** | (2006.01) |
| ***B21B 25/02*** | (2006.01) |
| *B21B 25/00* | (2006.01) |

(52) U.S. Cl.
CPC ..... *B21B 17/02* (2013.01); *B21B 19/04* (2013.01); *B21B 25/02* (2013.01); *B21B 25/00* (2013.01)

(58) Field of Classification Search
CPC ..... B21B 17/02; B21B 25/00; B21B 25/02; B21B 19/04
USPC ..... 72/110
See application file for complete search history.

(56) References Cited

FOREIGN PATENT DOCUMENTS

| | | |
|---|---|---|
| DE | 10 2008 056988 A1 | 8/2009 |
| EP | 2 042 247 A1 | 4/2009 |

OTHER PUBLICATIONS

English Translation of EP 2042247.*
English Translation of DE 102008056988.*

* cited by examiner

*Primary Examiner* — David B Jones
(74) *Attorney, Agent, or Firm* — Dilworth & Barrese, LLP

(57) ABSTRACT

The invention relates to a method for producing seamless steel tubes in a rolling mill train with one or more consecutively positioned longitudinal or cross-rolling units and an inside tool which is used as mandrel bar or piercing plug during the rolling process. The aim is to provide a method to reduce the eccentricity of the rolling stock considerably. To achieve this, the longitudinal axis of the inside tool is forced by means of an apparatus to a movement in a distance to the longitudinal axis of the rolling stock. Simultaneously the rotation of the tool around its axis is kept, driven by the rolling stock during rolling.

11 Claims, 6 Drawing Sheets

METHOD AND DEVICE FOR PRODUCING SEAMLESS STEEL PIPES HAVING LOW ECCENTRICITY

Figure 1:
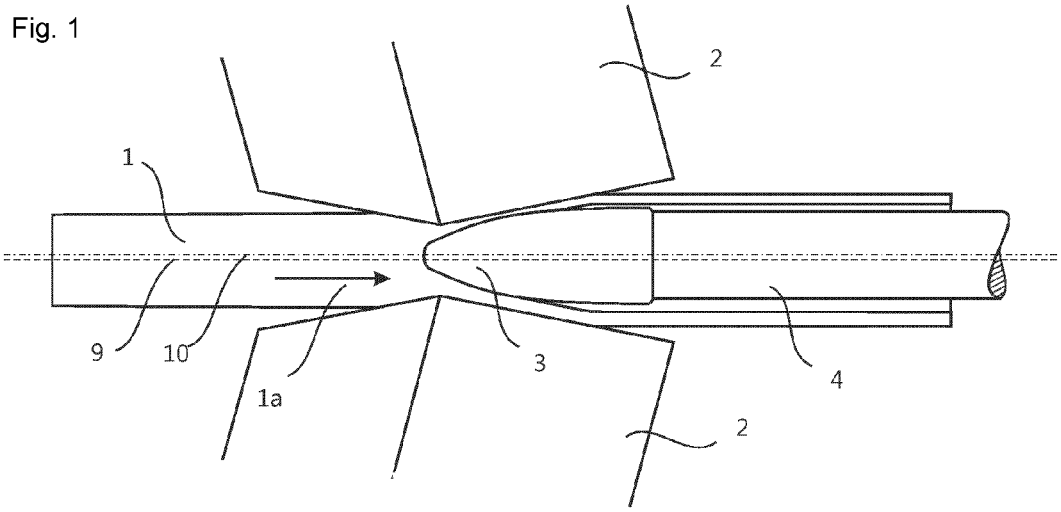

The invention relates to a method for producing seamless steel tubes according to the generic term of the patent claim 1. Seamless steel tubes are produced on different rolling trains. Most of these rolling trains commonly comprise three forming steps performed in sequence. In a first step (see FIGS. 1 and 2) the heated rolling stock (1), a continuous cast steel billet for instance, with solid cross-section is pierced to a hollow bloom. In general this step is performed on a cross-rolling mill, in which the steel billet is forced to a rotational motion (5) with forward feed by means of two or more working rolls, which are powered and rotating (6). Thus the billet is driven over a piercing plug (3). This process is also known as rotary piercing.

In the above described way the solid billet is formed into a hollow bloom. The piercing plug is mounted on a plug bar (4), which, again, is supported in axial direction on a thrust block while it can freely rotate around its longitudinal axis. The plug and—in case the piercing plug is rigidly fixed to the plug bar—the plug bar are driven by the rolling stock to a rotational motion (7 and 8). Here, in the theoretically ideal case, the axis of the piercing plug (10) and the axis of the rolling stock (9) lie on the same straight line. In this case, the piercing plug rotates centrically and generates a uniform wall thickness in the cross section of the rolling stock (see FIG. 2*a*). However, as in rolling praxis the position of the piercing plug is affected by the forces acting on it, the axis of the plug is always more or less shifted off the center line and then it performs an eccentric rotational motion (11) around the axis of the rolling stock in the direction of the plug rotation (see FIG. 2*b*).

In a second forming step the hollow bloom which is produced by the cross-rolling mill, is further formed with help of an inner tool, a mandrel bar, by longitudinal rolling or in a cross-rolling process. During this step mainly the wall thickness is reduced and the length increases accordingly. Then, in a third forming step the tube is in most cases finish-rolled without inner tool, and diameter and wall thickness are adjusted according to the customer's demand.

The diameter and the wall thickness of the finish-rolled tube have to meet given specifications, i.e. they have to be within given tolerances. In case that tolerances are not met, the product, the tube, is of minor value and the economic yield is low. For reasons of the stability of the rolled tubes during their later utilization in pipe lines, as component parts or constructive elements, mostly minus tolerances with respect to the wall thickness are demanded, i.e. at no part of the tube the wall thickness is allowed to be beyond a specified value (minus tolerance). Then, in order to keep minus tolerance safely, often tubes with greater wall thickness are produced. But this practice results in additional expenditure with respect to material, connected with higher production costs and again reduced economic yield. Therefore, from the economic point of view it is very important to keep wall thickness deviations as low as possible.

During each of the three forming steps, wall thickness deviations, i.e. deviations of the actual value of the wall thickness from the specified value, develop for different reasons. Due to their different developing mechanism the wall thickness deviations differ in their characteristic and amplitude. A particular big share of the wall thickness deviations at the finish-rolled tube is related to eccentricity (see FIG. 3). Eccentricity appears as a wall thickness distribution in the cross section of the tube with a maximum value $t_{max}$ and a minimum value $t_{min}$ which lie opposite to each other. In production praxis the value of eccentricity E is usually evaluated by the formula $E=(t_{max}-t_{min})/(t_{max}+t_{min})\times 100\%$.

The eccentricity develops mainly in the first forming step and in the following two steps it can only be reduced slightly. Therefore, for economic reasons it is very important to keep the development of eccentricity at a minimum during the first forming step, which usually is the billet piercing by cross-rolling.

Figure 3:
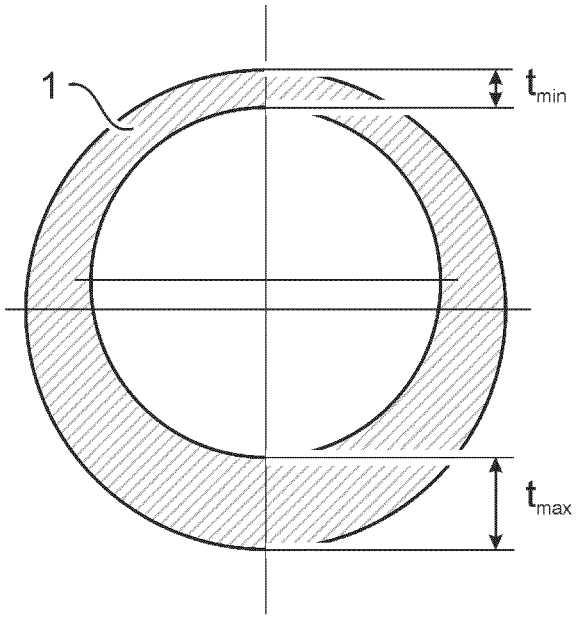

During cross-rolling the eccentricity develops due to the fact that the axis of the piercing plug is shifted parallel to the axis of the rolling stock, in addition to this, eventually inclined by an angle. This shifting off the centric position is a result of forces, acting radially and having possibly different origins. The origins can be: An uneven distribution of temperature or material properties in the cross section of the rolling stock, an unroundness of the piercing plug due to wear, a bending of the plug bar, deviation from the axial alignment of the mill, the plug bar guides and the thrust block and others. In case of an eccentric position of the plug axis an eccentric wall thickness distribution is caused in the affected cross section of the rolling stock, as shown in FIG. 3.

According to the present state of knowledge and technology the problem of eccentricity is kept within limits by keeping the said influences as small as possible. Following this, it has to be taken care, for example, that the billet before piercing is heated evenly, that the rolling mill and the auxiliary devices are aligned exactly to each other, and that worn piercing plugs are exchanged at the right time. Under such conditions eccentricity values of 2 to 4% can be reached. But it is difficult to keep the said influencing parameters under control over longer time in production praxis. This is why in production praxis the eccentricity values often lie at 5 to 10% or even higher, causing considerable additional costs during production.

From the DE 2949970 C2 a rolling mill is known for piercing billets with a plug bar supported freely rotating. In case of a fixed connection between piercing plug and plug bar, the piercing plug and the plug bar rotate with a rotational speed which is forced by the working rolls.

Due to this rotational movement and due to the according low relative movement between piercing plug and rolling stock the wear of the plug is kept low at least in the steady state phase of the rolling process. However, by disturbing influences, like temperature differences in the cross section of the billet, the axis of the piercing plug is easily shifted off the center line of the rolling stock, leading to an eccentric wall thickness distribution in the cross section of the produced hollow bloom.

According to the DE 3602523 C1 a rolling mill for piercing billets with driven plug bar is known, where, before the piercing process starts, the plug bar is brought to a rotational speed which is adapted to the rotational speed of the billet to be pierced. By doing this, it is ensured that the relative speed between piercing plug and rolling stock is low. Thus the wear of the piercing plug is reduced further. However, with this solution, too, the position of the axis of the piercing plug is instable and depending on disturbing influences. Then an eccentricity of the wall thickness of the produced hollow bloom develops, resulting from an unwanted and uncontrollable shifting of the axis of the piercing plug.

In the DE 2008 056 988 A1 a method is described, with which the eccentricity can be reduced significantly and reliably. With this method, for example with help of an additional drive, the piercing plug is rotated opposite to the rotational movement of the rolling stock. Rolling tests have confirmed that in this way a major share, approximately 50%, of the eccentricity is eliminated. However, this method has the disadvantage that the piercing plug is worn after short time because of the relative movement between piercing plug and rolling stock and due to the resulting shear stresses acting on the surface of the piercing plug. Also, as a consequence of the relative motion, defects can occur on the inner surface of the rolling stock, possibly leading to rejects. This is why the aim of cost saving is reached to a very limited extend by this method.

Basis for the present invention is the task to create a method, with which the described disadvantages can be avoided, by reducing the eccentricity reliably without occurrence of extended relative movement between piercing plug and rolling stock and thus avoiding increased wear and inner defects.

The task is performed by a method with the attributes described herein.

As a result of the application of this invention, the eccentricity of the rolling stock is reduced considerably, without increasing the wear of the piercing plug and without possible development of additional inner defects.

Figure 4:
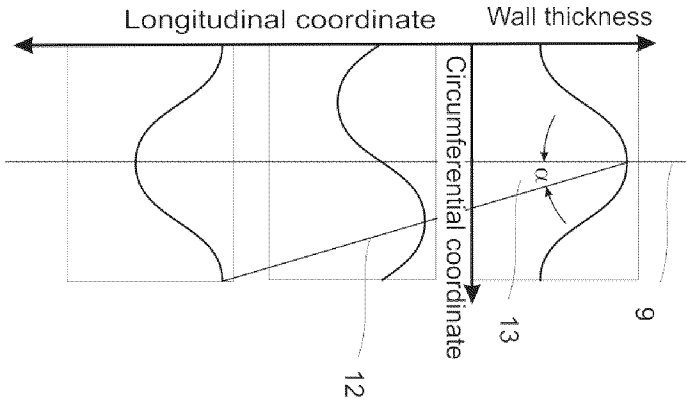

A basis of the invention is the finding that the eccentric rotational movement of the plug axis is to be contemplated as superposition of mostly two kind of vibration with different frequency (rounds per time) and with different amplitude (distance between axis of the piercing plug and axis of the rolling stock). Due to the superposition of the vibrations, the position and the distance of the plug axis to the axis of the rolling stock change during the rolling process and accordingly, at the rolled hollow bloom a characteristic distribution of the wall thickness values over length and circumference can be found. In FIG. 4 the distribution of the wall thickness is represented schematically, where the distribution is a result of a rotational motion with a constant frequency, which differs from the frequency of the movement of the rolling stock. The lines of equal wall thickness (In FIG. 4, as an example, the line (12) of the maximum wall thickness is shown.) form an angle $\alpha$ (13) with the longitudinal axis of the rolling stock.

If the rotational movement of the axis of the piercing plug is a combination of two rotational motions of different frequency, the wall thickness values appear as two superimposing types of wall thickness distribution where the two types of wall thickness distribution exhibit different angles between the lines of equal wall thickness and the longitudinal axis of the rolling stock.

According to the invention, from this finding it is derived, that it is not the rotation of the piercing plug itself that has to be changed in order to control the development of eccentricity, as described in the DE 10 2008 056 988 A1, but it is the rotational motion of the axis of the plug which has to be controlled. The movement of the axis can be changed without changing the rotation of the plug, as is illustrated by the following example of application (see FIG. 5).

The shaft of the piercing plug (14), this is a constructive part, which is fixed to the piercing plug, is freely rotating supported by the plug bar by means of low friction gliding surfaces (16), which are provided with help of ceramic surface coating and application of graphite lubrication. The longitudinal axis of the piercing plug is offset with respect to the longitudinal axis of the plug bar. The offset is a millimeter or a few millimeters. The plug bar is equipped with a rotation drive. By means of the described device of an eccentric connection of piercing plug and plug bar and when the plug bar is rotating the position of the longitudinal axis of the piercing plug is influenced without changing the rotational motion of the piercing plug.

Figure 6:
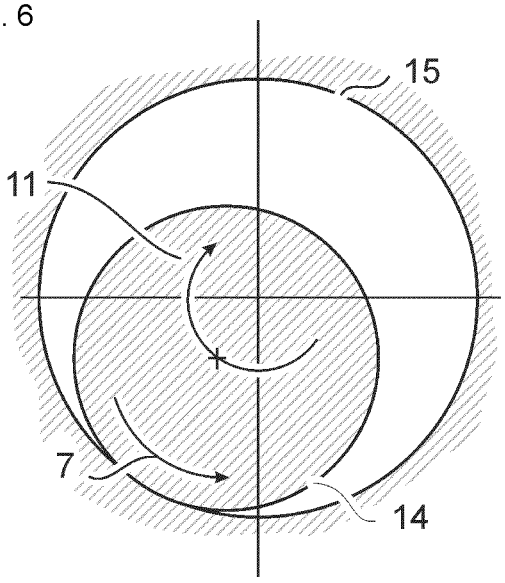

Another device of an advantageous embodiment of the invention is represented in FIG. 6. Between piercing plug and plug bar an adapter is used, in which the shaft of the plug (14), with help of a gear wheel, is rolling on a hollow gear wheel, which is fixed on the plug bar. With this arrangement the rotational motion (7) of the piercing plug generates a rotation (11) of the axis of the plug, which is opposite to the rotation of the piercing plug. With the same arrangement the plug bar axis, too, can be forced to a rotation, which is opposite to the rotation of the plug bar, in case that the plug bar and the plug are connected rigidly.

Another finding, which is basis of the invention, is related to the frequency of the vibration or rotational motion respectively, to which the plug axis is forced. The higher the frequency in comparison to the frequency of the rotation of the rolling stock, the greater is the angle (13, see FIG. 4) between the lines of equal wall thickness and the axis of the rolling stock. With very high frequency compared to the frequency of the rotation of the rolling stock these lines lie like screw lines along the longitudinal axis of the rolling stock. Such a development of the wall thickness deviation has the advantage, that in following longitudinal rolling processes a compensation of differing wall thickness can easily be achieved, due to the smaller distance between maximum and minimum values of wall thickness. This is because in case that the axial distance between wall thickness maximum and wall thickness minimum is small, the position of the inner tool keeps stable centric and a medium wall thickness appears, i.e. the eccentricity is eliminated partly.

This effect is used according to another embodiment of the invention, by forcing the plug axis to a high-frequency rotational motion in the direction or in opposite direction of the rotation of the rolling stock and the plug. On one hand the forced rotation avoids a natural vibration with the usual development of the eccentricity and on the other hand it generates a high-frequency eccentric rotation and thus a kind of eccentricity, which can easily be compensated in a following longitudinal rolling process.

The teaching of the invention can also be used in the second forming step in order to force an eccentric motion of the inside tool. This motion supports the material flow in circumferential direction of the rolling stock and in this way it leads to a compensation of the wall thickness deviations in the cross section of the rolling stock.

EXPLANATION TO THE FIGURES

FIG. 1: Representation of the piercing process in a cross-rolling mill with help of a longitudinal section of the assembly of rolling stock and tools.

Figure 2A:
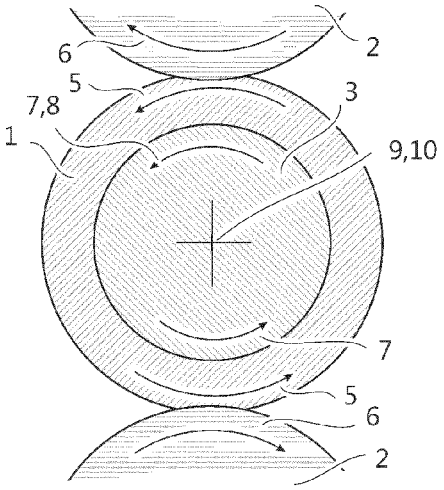
Figure 2B:
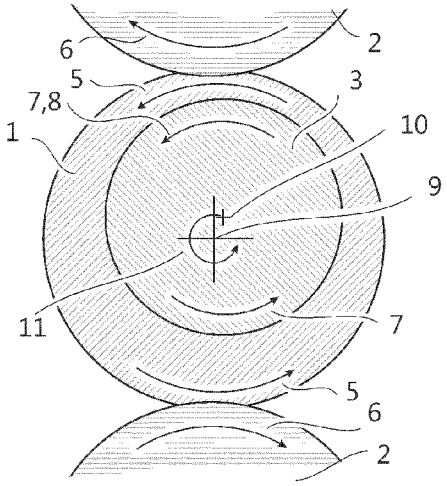

FIG. 2: Representation of the piercing process in a cross-rolling mill with help of a cross section of the assembly of rolling stock and tools. (The representation is without showing the sidewise guides as they are irrelevant in the described context.) In FIG. 2*a* a centric piercing process is shown and in FIG. 2*b* an eccentric piercing process.

FIG. 3: Representation of a cross section of the rolling stock with eccentricity of the wall thickness. The value of eccentricity is determined with $(t_{max}-t_{min})/(t_{max}+t_{min})\times 100\%$.

FIG. 4: Representation of the distribution of the wall thickness of the rolling stock versus longitudinal coordinate and circumferential coordinate of the rolling stock.

Figure 5:
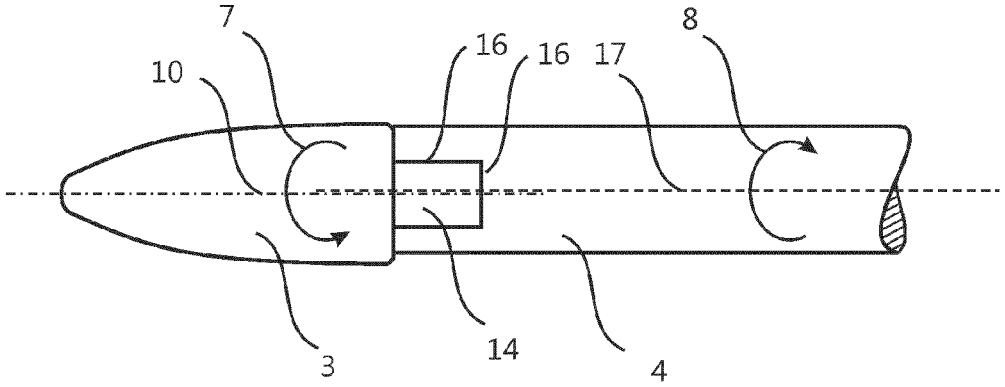

FIG. 5: Representation of a device for generating an eccentric rotational movement of the plug axis with which the rotation of the plug is in the direction and with the speed of the rotation of the rolling stock.

FIG. 6: Representation of the generation of a rotational movement of the piercing plug axis which is opposite to the rotational motion of the piercing plug, with help of a gear wheel rolling inside a hollow gear wheel.

LIST OF REFERENCE NUMERALS

1 Rolling stock
1*a* Direction of rolling
2 Working roll
3 Piercing plug
4 Plug bar
5 Rotational motion of the rolling stock
6 Rotational motion of the rolls
7 Rotational motion of the piercing plug
8 Rotational motion of the plug bar
9 Longitudinal axis of the rolling stock
10 Longitudinal axis of the piercing plug
11 Rotational motion of the plug axis
12 Line of equal wall thickness
13 Angle between a line of equal wall thickness and the longitudinal axis of the rolling stock
14 Shaft of the plug with annual gear
15 Hollow gear wheel
16 Gliding surface
17 Longitudinal axis of the plug bar

The invention claimed is:

1. A method of producing seamless steel tubes in a rolling mill train with one or more consecutively positioned longitudinal or cross-rolling units and a tool, which is used inside the rolling stock (1) during rolling, implemented as a mandrel bar or as a plug bar (4) with a piercing plug (3) arranged on a front tip of the bar (4), comprising piercing the rolling stock (1) with the piercing plug (3), rotating (7) the piercing plug (3) around its longitudinal axis (10) by rotating (5) the rolling stock (1) around its longitudinal axis of rotation (9), offsetting a longitudinal axis of rotation (10) of the piercing plug (3) a distance (11) from the longitudinal axis of rotation (9) of the rolling stock (1), keeping the rotational motion (7) of the piercing plug (3) around its longitudinal axis (10) in the direction of the rotation (5) of the rolling stock (1), and revolving the longitudinal axis of rotation (10) of the piercing plop (3) about the longitudinal axis (9) of the rolling stock (1).

2. A method according to claim 1, wherein the rotational motion of the piercing plug (3) generated by the rolling stock (1) generates the rotational movement of the axis (10) of the piercing plug (3) in an opposite direction to the rotation of the piercing plug (3).

3. A method according to claim 2, wherein the rotational motion of the piercing plug (3) and revolving of the axis (10) of the piercing plug (3) about the longitudinal axis (9) of the rolling stock (1) are in opposite clockwise or counterclockwise directions from one another.

4. A method according to claim 1 wherein the longitudinal axis (10) of the piercing plug (3) is forced to rotate with a higher frequency compared to the rotation of the rolling stock (1).

5. A method in accordance with claim 1, wherein the piercing plug (3) revolves around the axis (17) of the bar (4) upon rotation of the piercing plug (3) about its axis (10).

6. A method according to claim 1, additionally comprising passing the rolling stock (1) between a pair of rolls (2) as the rolling stock (1) is pierced by the piercing plug (3).

7. Apparatus for generating movement (11) of a longitudinal axis of rotation (10) of a piercing plug (3) a distance from a longitudinal axis of rotation (9) of rolling stock (1) pierced by the piercing plug (3), comprising a mandrel bar or plug bar (4) with the piercing plug (3) arranged on a front tip of the bar (4), such that rotational motion of the piercing plug (3) around its longitudinal axis (10) is kept in the direction of the rotation of the rolling stock (1), wherein the piercing plug (3) is arranged on the bar (4) with the respective axes of rotation (17, 10) offset from one another, the piercing plug (3) revolves around the axis (17) of the bar (4) upon rotation of the piercing plug (3) about its axis of rotation (10), and the axis of rotation 10 of the piercing plug (3) revolves about the axis (9) of rotation of the rolling stock (1).

8. A method according to claim 1, comprising arranging the piercing plug (3) on the front tip of the bar (4), arranging the axis (10) of the piercing plug (3) offset from the axis (17) of the bar (4), and driving and rotating the rolling stock (1) between two rotating rolls (2) by the rotating (7) piercing plug (3).

9. An apparatus according to claim 7, wherein the piercing plug (3) is arranged on the bar (4) to rotate in an opposite direction from rotation of the axis (10) of the piercing plug (3).

10. An apparatus according to claim 7, wherein the piercing plug (3) comprises a shaft (14) and additionally comprising gliding surfaces (16) through which the piercing plug shaft (14) is supported on the bar (4), the position of the longitudinal axis (10) of the piercing plug (3) is influenced without changing the rotational motion of the piercing plug (3).

11. An apparatus according to claim 7, wherein the piercing plug (3) comprises a shaft (14), the bar (4) comprises an adapter in turn comprising a hollow gear wheel (15) in which the shaft (14) is positioned such that rotational motion (7) of the piercing plug (3) generates rotation (11) of the axis (10) of the piercing plug (3) in an opposite direction.

* * * * *